United States Patent [19]

Shay

[11] Patent Number: 4,768,717

[45] Date of Patent: Sep. 6, 1988

[54] NOZZLE

[75] Inventor: Joseph J. Shay, Waterbury, Conn.

[73] Assignee: Specialty Packaging Licensing Company, Wilmington, Del.

[21] Appl. No.: 14,697

[22] Filed: Feb. 12, 1987

[51] Int. Cl.[4] ..... B05B 7/10

[52] U.S. Cl. ..... 239/403; 239/428; 239/428.5

[58] Field of Search ..... 239/403, 400, 428.5, 239/430, 431, 333, 343, 370, 371, 499, 573, 428

[56] References Cited

U.S. PATENT DOCUMENTS

| | | | |
|---|---|---|---|
| 1,620,209 | 3/1927 | Ihne . | |
| 2,218,189 | 10/1940 | Allen | 169/11 |
| 2,250,079 | 7/1941 | McDonald | 299/120 |
| 2,378,348 | 6/1945 | Wilmes et al. | 299/120 |
| 2,603,469 | 7/1952 | Bedford et al. | 261/116 |
| 3,236,458 | 2/1966 | Ramis | 239/338 |
| 3,369,756 | 2/1968 | Ramis | 239/338 |
| 3,836,076 | 9/1974 | Conrad et al. | 239/8 |
| 3,946,947 | 3/1976 | Schneider | 239/428.5 |
| 4,013,228 | 3/1977 | Schneider | 239/428.5 |
| 4,219,159 | 8/1980 | Wesner | 239/428.5 |
| 4,313,568 | 2/1982 | Shay | 239/333 |
| 4,322,292 | 3/1982 | Knox | 239/428.5 |
| 4,403,739 | 9/1983 | Knapp et al. | 239/428.5 |

FOREIGN PATENT DOCUMENTS

| | | | |
|---|---|---|---|
| 2562202 | 10/1985 | France | 239/428.5 |

*Primary Examiner*—Andres Kashnikow
*Assistant Examiner*—Michael J. Forman
*Attorney, Agent, or Firm*—Dallett Hoopes

[57] ABSTRACT

This invention relates to a nozzle for dispensing and aerating liquids. The nozzle provides for the formation of a substantially hollow conical vortex which aspirates air into the nozzle. The vortex is formed within a first chamber so that the base of the vortex impinges upon the chamber walls. This impingement results in the formation of a turbulent film which, when brought in contact with the aspirated air, results in aeration of the liquid forming the film. A foam-like characteristic is given the liquid by the entrapment of the air as the liquid is dispensed. The aspirated air enters through the downstream end of the nozzle but is directed both towards the front of the vortex and towards the rear of the vortex.

2 Claims, 4 Drawing Sheets

NOZZLE

BACKGROUND OF THE INVENTION

In the packaging of many liquid household products, e.g., window cleaners, insect poisons, cleaning fluids, etc., it has been found market-attracrive to include, as part of the package, a finger actuated dispensing pump. These pumps are generally fitted with nozzles which are capable of product delivery in a spray mode and/or a stream mode. Most nozzles produce the spray mode by causing the liquid product to be broken up into small particles as it is dispensed in a vortical state from the nozzle. The desired vortex is generally formed by forcing the liquid to traverse a swirling path as the liquid exits the nozzle outlet orifice. The swirling path can be accomplished by the use of any of the well known "swirl chamber" devices which are associated with the nozzle. See for example the devices of U.S. Pat. No. 4,358,057; U.S. Pat. No. 4,257,751; and U.S. Pat. No. 4,161,288.

The spray mode of delivery is preferred over the stream mode in those applications where the product is to be applied evenly over a relatively large area. However, due to the break-up of the liquid, some of the product will be delivered as a fine mist. Also a fine mist can be formed when the product impacts the surface on which it is sprayed. When the product is applied in an enclosed area, e.g., a shower stall, there is the possibility that the user will inhale some of the mist. Even in open areas, the mist is apt to settle where not desired, e.g., the user's wearing apparel. When the product is toxic or corrosive, this inhalation and settling is undesirable if not blatantly dangerous.

To overcome the problems created by the fine mist, the pump industry has tried aeration of the small liquid particles subsequent to their exiting the swirl chamber. Such aeration gives at least a portion of the dispensed liquid a foam characteristic which does not yield the unwanted fine mist—indeed the foamed liquid is further beneficient in that it entraps any fine mist which comes into contact with it. Aeration of the small liquid particles is conventionally achieved by providing an open ended chamber which surrounds and extends outwardly of the nozzle outlet orifice and which has air aspirating ports generally located between the nozzle outlet orifice and the open end of the chamber. The thus aspirated air is then entrained in the dispensed liquid to achieve the aeration. Generally, these aspiration ports are located between the nozzle outlet orifice and the back-side of the vortex formed by the swirl chamber.

A different approach is provided by the nozzle disclosed in my co-pending application, Ser. No. 659,684, filed Oct. 11, 1984 now U.S. Pat. No. 4,669,665 granted June 2, 1987. The nozzle disclosed therein achieves foam formation principally by aeration of a turbulent film of the product to be dispensed. To produce the turbulent film, the nozzle first causes the formation of a vortex of the product and then causes the vortex to impinge, at its base end, on a wall of a nozzle furnished chamber. The chamber surrounds and extends outwardly from the nozzle outlet orifice and is closed off to aspirated incoming air flow except from its discharge end. The aspirated incoming air encounters the turbulent film in a principally counter-current manner.

It is an object of this invention to provide an improved foam-dispensing nozzle, which nozzle provides for high aeration of the dispensed product.

THE INVENTION

This invention relates to a foam-dispensing nozzle. The nozzle of this invention is suitable for use with any of the types of dispensing systems which can deliver liquid product under pressure to the nozzle. Exemplary of such systems are aerosol systems, trigger-actuated pumps, finger-actuated pumps, and the like. The subject nozzle can be mounted to the dispensing stem or to the bore barrel, as the case may be, for any particular dispensing system.

More particularly, the nozzle of this invention includes a passageway through which the liquid to be dispensed can pass to the nozzle while under pressure. The nozzle also includes a mechanical break-up structure, e.g., swirl chamber, which is located in between and in liquid communication with the passageway and a nozzle outlet orifice. The mechanical break-up structure causes the pressurized liquid communicated to it to be dispensed through the nozzle outlet orifice as a swirling conical sheet having sufficient angular velocity to form a substantial hollow conical vortex.

To provide a highly suitable vortex, it has been found that the mechanical break-up structure is preferably of the swirl chamber type. The vortex formation by conventional swirl chambers is well known to those skilled in the art. Any of the swirl chamber configurations presently in the marketplace or disclosed in printed publications are suitable so long as they are capable of forming the before mentioned hollow conical vortex.

Downstream of the nozzle outlet orifice, the subject nozzle provides a hollow first chamber which is open at both of its ends. The first chamber is preferably an elongated cylinder which is substantially coaxial with the nozzle outlet orifice. The first chamber is located with respect to the nozzle outlet orifice so that the base of the vortex will impinge upon the interior wall of the first chamber to form a turbulent film. Aeration of this film, and thus the formation of a foam, is achieved by aspiration of air into the interior of the vortex and into an air passageway which is exterior of the first chamber and which extends from the downstream end to the upstream end of the first chamber. Thus, aeration of the turbulent film from two opposite directions is achieved yielding a highly aerated foam. It is an important feature of this invention that the aspiration of air into the nozzle be only from the downstream end of nozzle. The air passageway is closed off to all other points of air aspiration.

The first or foaming chamber is preferably located and at least partially within a second chamber. The second chamber is open at its downstream end and closed off at to air flow at its upstream end. At its upstream end, the second chamber preferably is closed off by an end wall in which the nozzle outlet orifice is located. To form the rest of the second chamber, there is connected to the end wall an elongated wall which extends downstream therefrom. The space between the opposed exterior surface of the first chamber and the interior surface of the second chamber provides an air passageway by which air is aspirated into the upstream end of the first chamber. It is preferred that the second chamber be defined by a cylinder open at its downstream end and closed to air flow at its upstream end by a planar wall. It is most highly preferred to combine this preferred form of the second chamber with the first chamber being a cylinder open at both of its ends. The open cylinder which defines the first chamber is most conveniently coaxial with the nozzle outlet orifice. When this combination is used, the first chamber has an outside diameter which is smaller than that of the inside diameter of the second chamber whereby an annular air passageway is provided between these two chambers.

Aspiration of air into the nozzle of this invention is effected by the formed vortex which provides, at its interior, a pressure which is lower than ambient pressure. This lower pressure results in air being aspirated into the interior of the vortex and into the air passageway defined by the two chambers. The greater the difference between the ambient pressure and the internal vortex pressure, the greater the amount of air that will be aspirated. Since the availability of air is at least partially responsible for the amount of aeration achieved, the amount of foaming of the dispensed liquid is directly affected by the strength of the vortex. Achieving the desired vortex strength is an empirical science and depends upon the pressure which the pump delivers the liquid to the nozzle, the design of the mechanical break-up structure and the physical characteristics of the liquid being dispensed.

It has been found that the longer the turbulent film is exposed to the aspirated air, the greater the aeration of the dispensed liquid and thus, the greater its foam characteristic. This time of exposure is easily controlled by dimensioning the length of the first chamber. As is the case in determining suitable vortex strength, the determination of optimal first chamber length is an empirical science. Factors affecting suitable length are the amount of available aspirated air and the physical characteristics of the liquid, e.g., surface tension, viscosity, etc. It should be noted, however, that the first chamber should not be of excessive length as the aerated liquid may not be dispensed therefrom with a force sufficient to satisfy the user's purposes. Generally speaking, first chambers having a length within the range of from about 0.100 to about 0.400 inches and an average inside cross sectional width within the range from about 0.120 to about 0.300 inches are suitable for use with most liquid products. (When the first chamber is a hollow cylinder, the inside width will be the diameter of the cylinder.) For most commercial applications, a preferred first chamber will have a length within the range from about 0.100 to about 0.250 inches and a diameter within the range from about 0.120 to about 0.240 inches.

When the second chamber is used in conjunction with the first chamber to form the air passageway, the second chamber will, generally speaking, have a length in the range of from about 0.100 to about 0.400 inches and an average inside cross sectional width within the range of from about 0.240 to about 0.450 inches. As is the case for the first chamber, when the second chamber is a hollow cylinder, the inside width will be the diameter of the cylinder. Preferred dimensions for the second chamber, for use with the preferred above described first chamber, are a length within the range of from about 0.100 to about 0.400 inches and an average inside cross sectional width within the range of from about 0.240 to about 0.450 inches.

The air passageway defined between the first and second chamber should be fairly open so a to not frustrate the aspiration of air therethrough. Generally, the air passageway should provide a cross-sectional area to flow within the range of from about 0.175 to about 0.050 square inches. Most commercial applications will use from about 0.150 to about 0.100 square inches.

The nozzle of this invention can be conveniently formed by injection molding and from thermoplastic materials such as polypropylene, polyethylene, polyethylene terephthalate, etc.

These and other features of this invention contributing to satisfaction in use and economy in manufacture will be more fully understood from the following description of preferred embodiments of this invention and the accompanying drawings in which.

Figure 1:
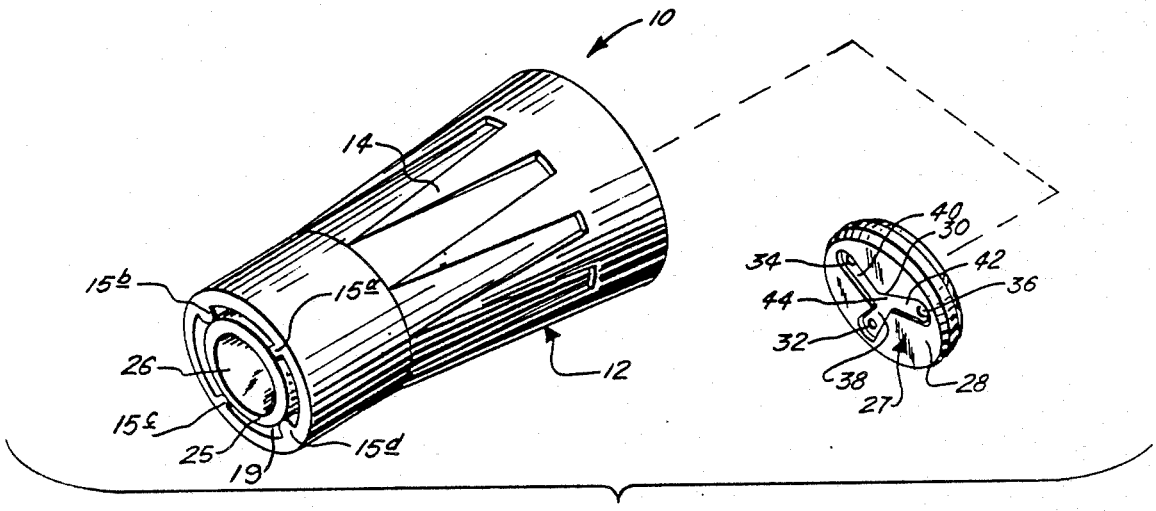
FIG. 1 is an exploded view of a nozzle of this invention.
Figure 2:
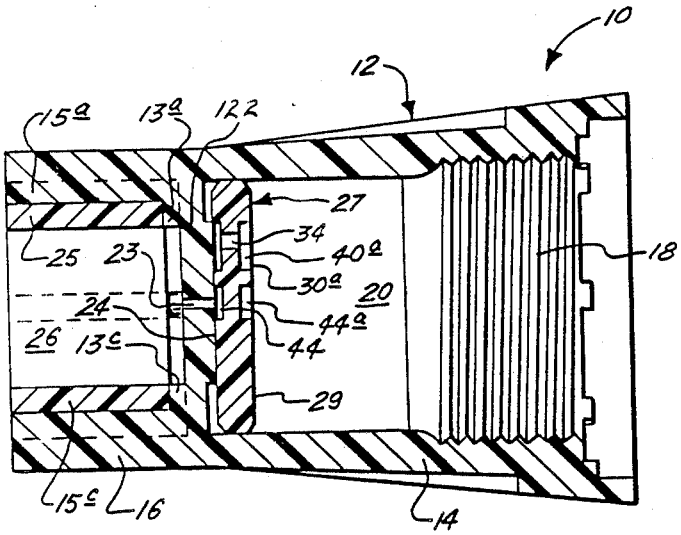
FIG. 2 is a sectional view of the nozzle shown in FIG. 1.

Referring now to FIGS. 1 and 2, there can be seen a nozzle of this invention, generally desiqnated by the numeral 10 which includes a nozzle skirt 12 and a swirl chamber button 27. The nozzle skirt 12 has a frusto-conical portion 14 and a cylindrical portion 16. As is shown in FIG. 2, there is helical thread 18 about the inside wall of the upstream end of frusto-conical portion 14. Helical thread 18 is for threaded cooperation with a complimentary thread found about the terminal end of a bore barrel used on a typical trigger pump of the type shown in U.S. Pat. No. 4,161,288. Just downstream of helical thread 18 is liquid passage 20. Liquid passage 20 will be filled with pressurized liquid which is fed through the bore of a pumping device.

At the downstream end of liquid passage 20 is wall 22. Wall 22 has a planar surface 24 which faces into liquid passage 20. On the opposite side of wall 22, there is provided cylinder 25 which is coaxially located with respect to nozzle exit orifice 23 which traverses wall 22. Cylinder 25 defines first chamber 26 which is open at both of its ends.

Cylinder 25 is located downstream of nozzle exit orifice 23 at a distance such that the vortex of liquid leaving orifice 23 will intersect, at the vortex base, the inside wall of cylinder 25. First chamber 26 is located within second chamber 19 which is defined by the inside cylindrical wall of cylindrical portion 16 and the outside face of wall 22. To maintain cylinder 25 in that location, there are provided elongated protuberances 15*a*, 15*b*, 15*c* and 15*d*. The fit between these protuberances and cylinder 25 is sufficiently tight so as to ensure that cylinder 25 is not easily removable from its location. In FIG. 2, it is seen that cylinder 25 is displaced away from the outside face of wall 22. This spacing is obtained by way of a foot located at the base of each protuberance. For protuberances 15*a* and 15*c*, their respective feet are labeled 13*a* and 13*c*. It is to be understood that protuberances 15*b* and 15*d* have similar feet.

So that cylinder 25 cannot be accidentally knocked from its location, it is preferred that it be wholly within chamber 19.

Figure 3:
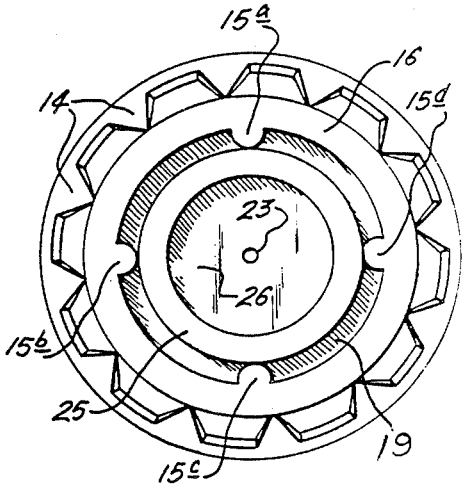
FIG. 3 is a front end view of the nozzle shown in FIG. 1.
Figure 4:
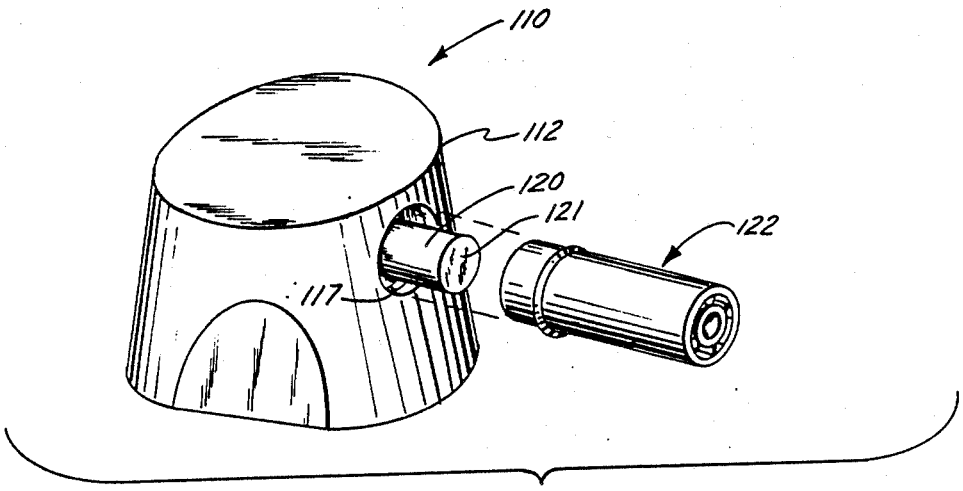
FIG. 4 is an exploded view of another nozzle of this invention.

Again, as can be seen in FIGS. 2 and 3, cylinder 25 is held by the protuberances and their feet away from the inside wall of cylindrical portion 16 and the outside face of wall 22. This maintenance is necessary to provide an air passageway which extends from the downstream or discharge end of nozzle 10 to the upstream end of cylinder 25. Thus, air being aspirated into nozzle 10 through this air passageway is capable of entering into chamber 26 to the rear of the vortex being discharged through nozzle exit orifice 23.

To effect the formation of a vortex comprised of the swirling conical sheet of liquid, there is provided swirl chamber button 27. For the embodiment shown in FIGS. 1–3, the swirl chamber button is a second piece of nozzle 10. Button 27 is dimensioned to have a diameter so that it can be snugly nested within liquid passage 20 as shown in FIG. 2. Swirl chamber button 27 has at least one planar face 28. Within planar face 28 is swirl chamber cavity 30 which is comprised of swirl chamber arms 38, 40 and 42 which are tangentially located with respect to center portion 44. The configuration of swirl chamber cavity 30 is conventional and is not critical to the operation of the nozzle of this invention so long as the chosen configuration provides the necessary vortex. To communicate liquid from liquid passage 20 to swirl chamber cavity 30, there is provided at the outmost extent of swirl chamber arms 38, 40 and 42 entrance ports 32, 34 and 36 respectively. As can be seen in FIG. 2, when swirl chamber cavity 30 achieves an abutting relationship with planar surface 24, a swirl chamber is created. Liquid entering into this formed swirl chamber under pressure will be required to take a swirling path which effects the formation of the desired vortex. Note further that in FIG. 2 that nozzle exit orifice 23 is located to overlie center portion 44 of swirl chamber cavity 30. It is from center portion 44 that the swirled liquid will exit through nozzle exit orifice 23.

It is desirable, from an assembly point of view, that swirl chamber button 27 have an additional planar face 29. Planar face 29 has its own swirl chamber cavity **30*a*. As seen in FIG. 2, swirl chamber cavity 30*a* is identical to swirl chamber cavity 30. Showing this similarity between the two swirl chamber cavities are swirl chamber arm 40*a* and center portion 44*a*. It is to be understood that the other portions of swirl chamber cavity 30*a* which are not shown are identical in shape, dimension, etc., as the ones comprising swirl chamber cavity 30. The advantage of providing swirl chamber button 27 with identical swirl chamber cavities on its opposite faces is that the swirl chamber button can be readily assembled within nozzle skirt 12 without regard to which side of the button is placed in abuttment with planar surface 24**.

Figure 5:
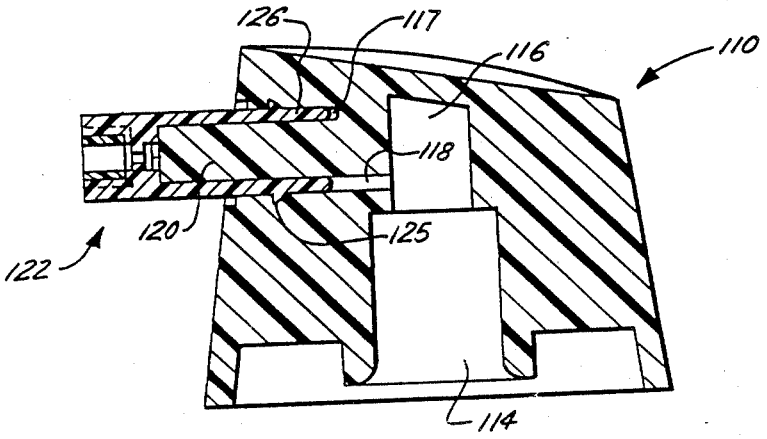
FIG. 5 is a sectional view of the nozzle shown in FIG. 4.

Another embodiment of this invention is shown in FIGS. 4–8. As can be seen in these Figures, nozzle 110 has a body, generally designated by the numeral 112 and a nozzle cylinder, generally designated by the numeral 122. Body 112 has a mounting cavity 114 which is dimensioned to achieve a tight fit with the dispensing stem of a finger-actuated pumping system. Immediately above and in liquid communication with mounting cavity 114 is liquid passage 16. Cut into body 112 is an annular recess 117. Annular recess 117 is dimensioned so that the upstream end of cylindrical body portion 126 of nozzle cylinder 122 can be fitted therein as shown in FIG. 5. As can also be seen in FIG. 5, at least a portion of annular recess 117 extends into and achieves liquid communication with liquid passage 116. This extended portion is designated by the numeral 118. Coaxially located within annular recess 117 is mounting post 120. Mounting post 120 terminates in a planar face 121.

Located about the upstream portion 126 of cylindrical body portion 124 is annular protuberance 125. Annular protuberance 125 assures a snug fit of upstream portion 126 within annular recess 117 as is shown in FIG. 5. Upstream portion 126 has a cylindrical interior wall which carries four spaced apart protuberances 128, 129, 130 and 131. The portions (portion 132 being one of them) of the cylindrical wall located between these protuberances will form liquid passageways when nozzle cylinder 122 is mounted within annular recess 117 so as to surround mounting post 120. The protuberances provide a frictional fit with mounting post 120 to aid in holding nozzle cylinder 122 in position.

Figure 8:
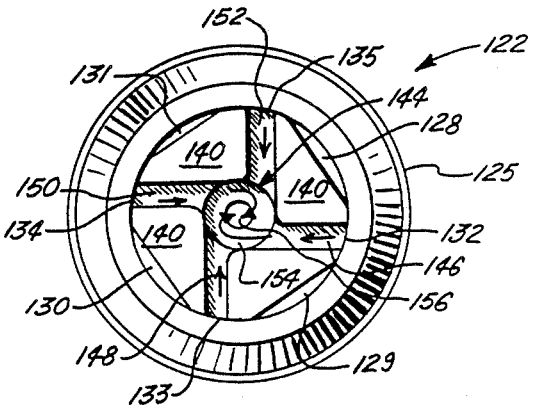
FIG. 8 is a rear end view of the nozzle cylinder shown in FIG. 4.

Separating upstream portion 126 from downstream portion 157 is circular wall 138. Circular wall 138 has an inside planar face 140 and outside planar face 142. As can be seen in FIG. 8, inside planar face 140 has a swirl chamber cavity 144 cut therein. Swirl chamber cavity 144 is of conventional construction and features swirl chamber arms 146, 148, 150 and 152 which are in tangential relationship with circular center portion 154. Note that the swirl chamber arms are located so as to be in liquid communication with liquid passageways 132, 133, 134 and 135, respectively. Circular center portion 154 is in liquid communication with nozzle exit orifice 156.

Figure 6:
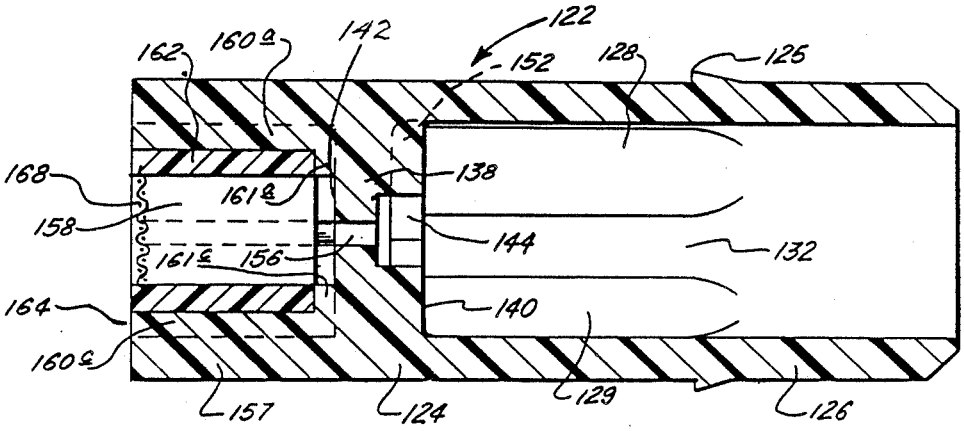
FIG. 6 is a sectional view of the nozzle cylinder shown in FIG. 4.
Figure 7:
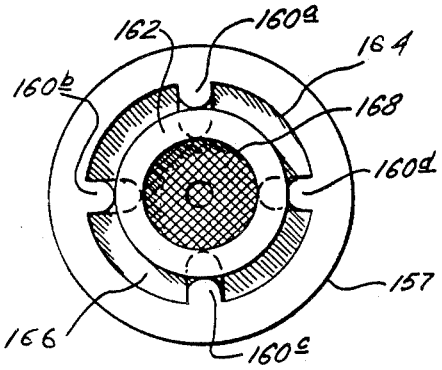
FIG. 7 is a front end view of the nozzle cylinder shown in FIG. 4.

Nozzle exit orifice 156 is coaxial with and surrounded by a cylindrical first chamber 158 which is defined by the inside wall of cylinder 162. Cylinder 162 and thus first chamber 158 are located within a second chamber 164 which is provided by the cylindrical inside wall of downstream portion 157 and outside planar face 142. The diameter of second chamber 164 is greater than the outside diameter of cylinder 162. Maintenance of cylinder 162 in its location within second chamber 164 is achieved by a forced fit between cylinder 162 and elongated protuberances **160*a*, 160*b*, 160*c*, 160*d*, as is shown in FIGS. 6 and 7. As in shown in FIG. 7, the dimensioning of cylinder 162 and the inside wall of downstream portion 157 provides for an annular air passageway 166. This annular air passageway is continuous to the upstream end of cylinder 162. Cylinder 162 is displaced downstream of planar face 142. This displacement is achieved by the utilization of feet which are integral with each of the protuberances. As can be seen in FIG. 6, foot 161*a* is associated with protuberance 160*a*, while foot 161*c* is associated with protuberance 160*c*. Protuberances 160*b* and 160*d* have similar foot portions which are not shown in the drawings. By having cylinder 162 so displaced from planar face 142, a continuation of air passageway 166 is provided so that air can be aspirated into the upstream end of first chamber 158**.

To further enhance the foam-producing capabilities of the nozzle of this invention, nozzle 122 can be fitted with screen disk 168 which snap-fits across the discharge end of first chamber 158. Screen disk 168 has a U.S. mesh within the range of from about 20 to about 50. It is to be understood that such a screen disk can also be utilized for the embodiment shown in FIGS. 1–3.

When nozzle cylinder 122 is mounted to mounting post 120, the planar face 121 of mounting post 120 will be in abutment with swirl chamber cavity 144 thereby providing a swirl chamber. Upon provision of liquid under pressure to liquid passage 116, it can be seen that such liquid will travel to extended portion 118 of annular recess 117. This liquid will then be routed along liquid passageways 132, 133, 134 and 135 to the arms 146, 148, 150 and 152 of the swirl chamber provided by swirl chambar cavity 144 and planar face 121. As is shown in FIG. 8, this liquid under pressure will be required to follow a path giving it a swirling action so that it is dispensed through nozzle exit orifice 156 to form a hollow conical vortex.

The dimensions, both diameter and length, of chambers 26 and 19 for the nozzle of FIGS. 1–3, and of chambers 158 and 164, for the nozzle of FIGS. 4–8, are such that (1) the base of the formed vortex will be intercepted by the inside cylindrical wall defining the respective first chambers and (2) an air passageway is provided so that aspirated air can be drawn into the front or discharge end of nozzles 10 and 110 and introduced into the upstream end of their respective first chambers, i.e., first chambers 25 and 158, respectively.

Figure 9:
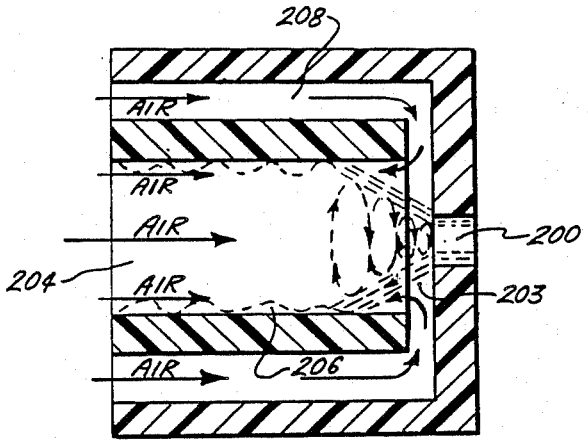
FIG. 9 is a schematic view of the flow of aspirated air and aeration of dispensed liquid as it occurs for nozzles of this invention.

FIG. 9 schematically shows the action of the vortex, the aspiration of air and the aeration of the dispensed liquid as it would occur in nozzles of this invention. As can be seen, liquid which has been forced through a mechanical break-up device, e.g., a swirl chamber, exits nozzle orifice 200. As required, the mechanical break-up structure causes the liquid to form a substantially hollow conical vortex 203 which is made of the liquid to be dispensed. The base of the vortex collides with the inner wall of first chamber 204 thereby resulting in the formation of a turbulent film 206. Hollow cylindrical vortex 203 causes air to be (1) aspirated towards its center and (2) to be drawn in and through air passageway 208 and directed into the rear of vortex 203. The thus aspirated air contacts vortex 203 and turbulent film 206 and provides the foam-producing aeration of the dispensed liquid.

I claim:

1. A nozzle for aerating and dispensing a liquid, which nozzle comprises:

(a) a passage means through which the liquid to be dispensed can pass while under pressure;

(b) a swirl chamber located in between and in liquid communication with said passage means and a nozzle outlet orifice disposed in the center of a permanently closed end wall, said swirl chamber causing at least a portion of the liquid communicated to it through said passage means to be dispensed through said nozzle outlet orifice as a swirling conical sheet having sufficient angular velocity to form a substantially hollow conical vortex, which vortex aspirates air into said nozzle into the inside of the vortex;

(c) tubular wall means defining a foaming chamber into which the orifice is directed and said tubular wall means being open at both its upstream and downstream ends, the upstream end being spaced from the closed end wall by aperture means, the wall means being adapted to intercept said vortex whereby a turbulent film of said liquid is formed on said tubular wall means; and (d) second wall means defining an air inlet passageway closed permanently along its length and extending parallel to and outside the tubular wall means, the second wall means extending from the downstream end through the aperture means to the upstream end of said foaming chamber, said second wall means terminating in an opening at the downstream end of said tubular wall means, whereby at least a portion of the air aspirated into said nozzle is directed from the downstream end of said wall means into the outside of said vortex and the foam emanating from the downstream end of the tubular wall means is unimpeded by the second wall means.

2. The nozzle of claim 1 wherein said tubular wall means and said second wall means are concentric cylindrical walls and are in substantial coaxial relation relationship with one another, and the nozzle outlet orifice is disposed on said coaxial axis.

* * * * *